US007682557B2

(12) United States Patent
Yong et al.

(10) Patent No.: US 7,682,557 B2
(45) Date of Patent: Mar. 23, 2010

(54) MULTIPLE PROCESSES OF HIGH PRESSURES AND TEMPERATURES FOR SINTERED BODIES

(75) Inventors: Zhou Yong, Spring, TX (US); Sike Xia, Houston, TX (US); Sharath Kolachalam, Houston, TX (US)

(73) Assignee: Smith International, Inc., Houston, TX (US)

( * ) Notice: Subject to any disclaimer, the term of this patent is extended or adjusted under 35 U.S.C. 154(b) by 150 days.

(21) Appl. No.: 11/639,484

(22) Filed: Dec. 15, 2006

(65) Prior Publication Data

US 2008/0145261 A1 Jun. 19, 2008

(51) Int. Cl.
*C22C 32/00* (2006.01)

(52) U.S. Cl. ..... 419/10; 75/230

(58) Field of Classification Search ..... 264/649; 419/10; 75/230

See application file for complete search history.

(56) References Cited

U.S. PATENT DOCUMENTS

| | | | |
|---|---|---|---|
| 3,379,503 | A | 4/1968 | McKenna |
| 4,137,106 | A | 1/1979 | Doi et al. |
| 4,356,034 | A | 10/1982 | Badrak |
| 4,407,775 | A | 10/1983 | Holman, Jr. et al. |
| 4,414,028 | A | 11/1983 | Inoue et al. |
| 4,490,319 | A | 12/1984 | Lee et al. |
| 4,525,178 | A | 6/1985 | Hall |
| 4,684,405 | A | 8/1987 | Kolaska et al. |
| 4,694,918 | A | 9/1987 | Hall |
| 4,723,996 | A | 2/1988 | Brunet et al. |
| 4,834,963 | A | 5/1989 | Terry et al. |
| 4,868,065 | A | 9/1989 | Maruyama et al. |
| 4,892,850 | A | 1/1990 | Hori et al. |
| 4,923,512 | A | 5/1990 | Timm et al. |
| 5,041,261 | A | 8/1991 | Buljan et al. |
| 5,089,182 | A | 2/1992 | Findeisen et al. |
| 5,139,720 | A | 8/1992 | Takeda et al. |
| 5,158,148 | A | 10/1992 | Keshavan |
| 5,173,107 | A | 12/1992 | Dreyer et al. |
| 5,290,507 | A | 3/1994 | Runkle |
| 5,370,195 | A | 12/1994 | Keshavan et al. |
| 5,421,852 | A | 6/1995 | Maruyama et al. |
| 5,441,693 | A | 8/1995 | Ederyd et al. |

(Continued)

FOREIGN PATENT DOCUMENTS

| | | | |
|---|---|---|---|
| EP | 0 061 988 | A1 | 10/1982 |

(Continued)

OTHER PUBLICATIONS

Patent Abstracts of Japan, Publication No. 2000-086347, published Mar. 28, 2000 (2 pages).

(Continued)

*Primary Examiner*—George Wyszomierski
*Assistant Examiner*—Weiping Zhu
(74) *Attorney, Agent, or Firm*—Osha • Liang LLP

(57) ABSTRACT

A method for forming a carbide composite that includes providing a mixture of carbide particles and a metallic binder in a container; sintering the container contents at a first processing condition having a pressure of less than about 45,000 psi; and sintering the container contents at a second processing condition having a pressure of greater than about 100,000 psi is disclosed.

21 Claims, 7 Drawing Sheets

U.S. PATENT DOCUMENTS

| | | | |
|---|---|---|---|
| 5,484,468 | A | 1/1996 | Ostlund et al. |
| 5,541,006 | A | 7/1996 | Conley |
| 5,574,954 | A | 11/1996 | Panchal |
| 5,598,621 | A | 2/1997 | Littecke et al. |
| 5,603,877 | A | 2/1997 | Kato et al. |
| 5,676,496 | A | 10/1997 | Littecke et al. |
| 5,707,578 | A | 1/1998 | Johnson et al. |
| 6,106,957 | A | 8/2000 | Fang |
| 6,156,259 | A | 12/2000 | Nishizawa et al. |
| 6,170,583 | B1 | 1/2001 | Boyce |
| 6,173,798 | B1 | 1/2001 | Bryant et al. |
| 6,214,079 | B1 | 4/2001 | Kear et al. |
| 6,287,360 | B1 | 9/2001 | Kembaiyan et al. |
| 6,472,057 | B2 | 10/2002 | Goela |
| 6,852,273 | B2 | 2/2005 | Ivanov et al. |
| 6,908,688 | B1 | 6/2005 | Majagi et al. |

FOREIGN PATENT DOCUMENTS

| | | |
|---|---|---|
| EP | 0109243 | 5/1984 |
| EP | 0381524 | 8/1990 |
| EP | 0 476 352 A1 | 3/1992 |
| JP | 4-217428 | 8/1992 |
| JP | 2000-86347 | 3/2000 |

OTHER PUBLICATIONS

Patent Abstracts of Japan, Publication No. 04-217428, published Aug. 7, 1992 (2 pages).

Extended European Search Report for European Application No. 07120349.1-1215, mailed on Nov. 6, 2009 (9 pages).

10
12
14
15
14
12
16

24

MULTIPLE PROCESSES OF HIGH PRESSURES AND TEMPERATURES FOR SINTERED BODIES

BACKGROUND OF INVENTION

1. Field of the Invention

Embodiments disclosed herein relate generally to composite materials used in cutting tools. In particular, embodiments disclosed herein relate to methods for forming composite materials used in cutting tools.

2. Background Art

Historically, there have been two types of drill bits used drilling earth formations, drag bits and roller cone bits. Roller cone bits include one or more roller cones rotatably mounted to the bit body. These roller cones have a plurality of cutting elements attached thereto that crush, gouge, and scrape rock at the bottom of a hole being drilled. Several types of roller cone drill bits are available for drilling wellbores through earth formations, including insert bits (e.g. tungsten carbide insert bit, TCI) and "milled tooth" bits. The bit bodies and roller cones of roller cone bits are conventionally made of steel. In a milled tooth bit, the cutting elements or teeth are steel and conventionally integrally formed with the cone. In an insert or TCI bit, the cutting elements or inserts are conventionally formed from tungsten carbide, and may optionally include a diamond enhanced tip thereon.

The term "drag bits" refers to those rotary drill bits with no moving elements. Drag bits are often used to drill a variety of rock formations. Drag bits include those having cutting elements or cutters attached to the bit body, which may be a steel bit body or a matrix bit body formed from a matrix material such as tungsten carbide surrounded by an binder material. The cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

Most cutting elements or inserts on roller cone bits are made of tungsten carbide, a hard material, interspersed with a binder component, preferably cobalt, which binds the tungsten carbide particles together. Conventional tungsten carbide composites are formed by subjecting green bodies of tungsten carbide particles and binder to a sintering process, typically vacuum sintering and/or hot isostatic pressing (HIP), such as that described in U.S. Pat. No. 4,684,405. The green body is heated to an elevated temperature in a controlled atmosphere to sinter the tungsten carbide particles together. HIP, as a sintering technique, has also enabled further densification of the sintered part and minimization of fracture initiating voids.

Cemented tungsten carbide composites, such as WC—Co, are well known for their mechanical properties of hardness, toughness and wear resistance, making the composites a popular material of choice for use in such industrial applications as mining and drilling where their mechanical properties are highly desired. Because of the desired properties, cemented tungsten carbide has been the dominant material used as cutting tools for machining, hard facing, wear inserts, and cutting inserts in rotary cone rock bits, and substrate bodies for drag bit shear cutters. The mechanical properties associated with cemented tungsten carbide and other cermets, especially the unique combination of hardness toughness and wear resistance, make these materials more desirable than either metals or ceramics alone.

Many factors affect the durability of a tungsten carbide composite in a particular application. These factors include the chemical composition and physical structure (size and shape) of the carbides, the chemical composition and microstructure of the matrix metal or alloy, and the relative proportions of the carbide materials to one another and to the matrix metal or alloy.

Cemented tungsten carbide is classified by grades based on the grain size of WC and the cobalt content and is primarily made in consideration of two factors that influence the lifetime of the tungsten carbide cutting structure: wear resistance and toughness. As a result, cutting elements known in the art are generally formed of cemented tungsten carbide with average grain sizes about less than 7 μm as measured by ASTM E-112 method, cobalt contents in the range of about 6-16% by weight, and hardness in the range of about 86 to 91 Ra.

For a WC/Co system, it is typically observed that the wear resistance, which is related to hardness, increases as the grain size of tungsten carbide or the cobalt content decreases. On the other hand, the fracture toughness increases with larger grains of tungsten carbide and greater percentages of cobalt. Thus, fracture toughness and wear resistance tend to be inversely related: as the grain size or the cobalt content is decreased to improve wear resistance of a specimen, its fracture toughness will decrease, and vice versa.

Due to this inverse relationship between fracture toughness and wear resistance, the grain size of tungsten carbide and cobalt content are selected to obtain desired wear resistance and toughness. For example, a higher cobalt content and larger WC grains are used when a higher toughness is required, whereas a lower cobalt content and smaller WC grain are used when a better wear resistance is desired. The relationship between toughness and wear for carbide composites having varying particle size and cobalt content is shown in FIG. 1.

Accordingly, there exists a continuing need for improvements in the material properties of composite materials used drilling or cutting tool applications.

SUMMARY OF INVENTION

In one aspect, embodiments disclosed herein relate to a method for forming a carbide composite that includes providing a mixture of carbide particles and a metallic binder in a container; sintering the container contents at a first processing condition having a pressure of less than about 45,000 psi; and sintering the container contents at a second processing condition having a pressure of greater than about 100,000 psi.

In another aspect, embodiments disclosed herein relate to a method for forming a sintered body that includes providing a mixture of hard particles and a metallic binder in a container; sintering the container contents at a first processing condition having a pressure of less than about 45,000 psi; and sintering the container contents at a second processing condition having a pressure of greater than about 100,000 psi.

Other aspects and advantages of the invention will be apparent from the following description and the appended claims.

DETAILED DESCRIPTION

In one aspect, embodiments disclosed herein relate to composite materials and methods of forming composite materials used in cutting tools and drill bits. More particularly, embodiments disclosed herein relate to methods of forming composite materials comprised of hard particulate materials surrounded by a ductile metallic phase.

In one embodiment of the present disclosure, any materials used to form cermet composite materials according to traditional HIP and/or vacuum sintering are suitable for use in the present disclosure. Ceramic hard particles using in the cutting tool industry which are generally subjected to traditional HIP and/vacuum sintering include metal carbides, borides, silicides, and nitrides. Cermet materials are materials that comprise both a ceramic material and a metal material. An example of a cermet material is cemented tungsten carbide (WC—Co) that is made from tungsten carbide (WC) grains and cobalt (Co).

Figure 1:
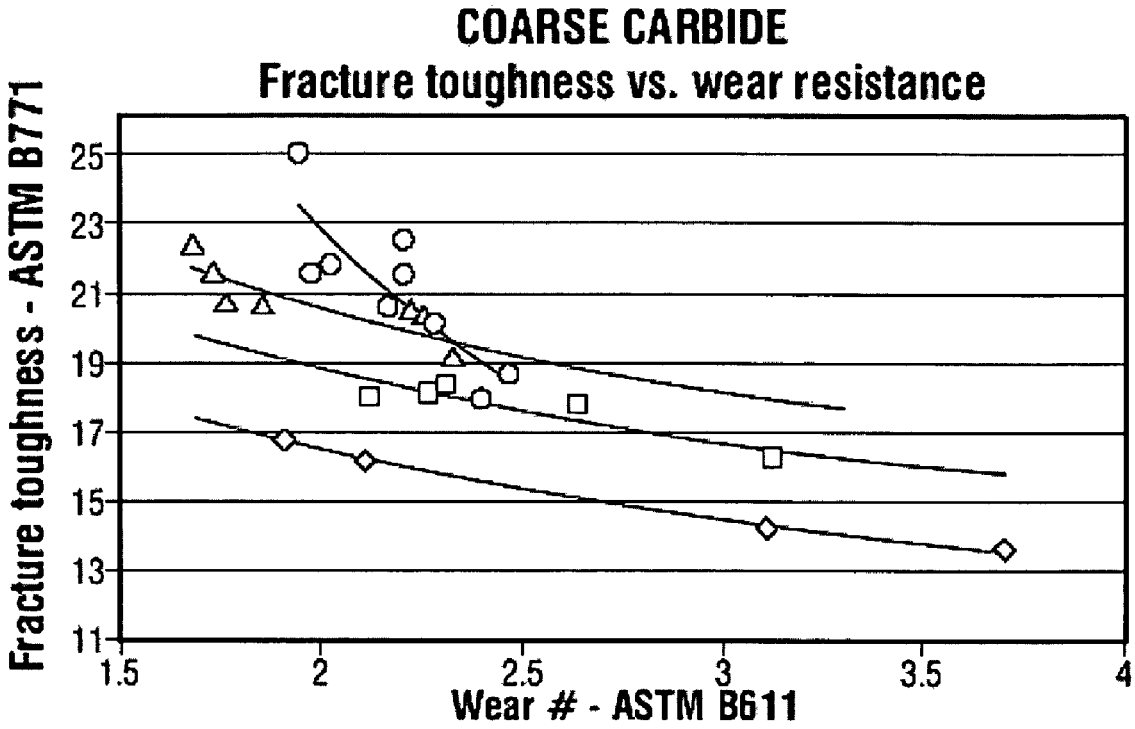
FIG. 1 shows a graphical comparison of fracture toughness vs. wear number for conventional carbides.
Figure 2:
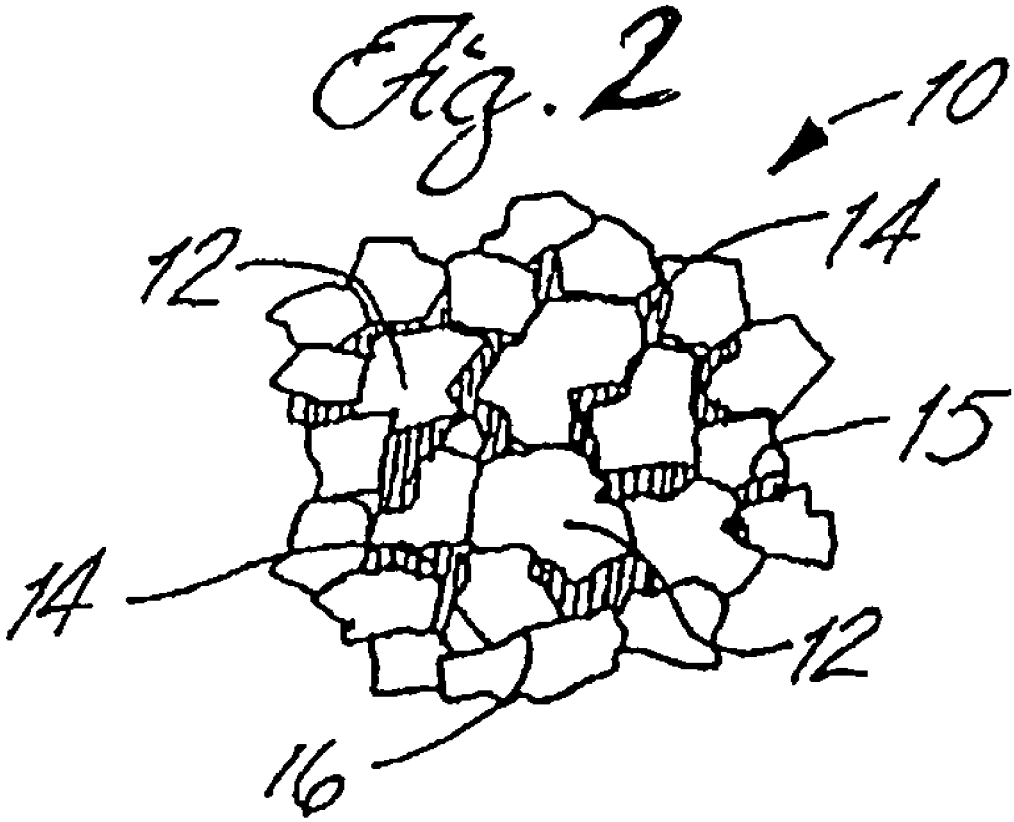
FIG. 2 shows a microstructure of a conventional tungsten carbide composite.

FIG. 2 illustrates the conventional microstructure of cemented tungsten carbide. As shown in FIG. 2, cemented tungsten carbide 10 includes tungsten carbide grains 12 that are bonded to one another by a cobalt phase 14. As illustrated, there are both tungsten carbide/tungsten carbide and tungsten carbide/cobalt interfaces. The unique properties of cemented tungsten carbide result from this combination of a rigid carbide network with a tougher metal substructure. The generic microstructure of cemented tungsten carbide, a heterogenous composite of a ceramic phase in combination with a metal phase, is similar in all cermets.

The relatively low fracture toughness of cemented tungsten carbide has proved to be a limiting factor in more demanding applications, such as inserts in roller cone rock bits, hammer bits and drag bits used for subterranean drilling and the like. It is possible to increase the toughness of the cemented tungsten carbide by increasing the amount of cobalt present in the composite. The toughness of the composite mainly comes from plastic deformation of the cobalt phase during the fracture process. Yet, the resulting hardness of the composite decreases as the amount of ductile cobalt increases. In most commonly used cemented tungsten carbide grades, cobalt is no more than about 20 percent by weight of the total composite.

As evident from FIG. 2, the cobalt phase is not necessarily continuous in the conventional cemented tungsten carbide microstructure, particularly in compositions having a low cobalt concentration. Further, while a relatively uniform distribution of tungsten carbide (or diamond) in a cobalt matrix is desired, typically inadequate mixing/infiltration results in agglomerates of tungsten carbide (or diamond) particles and pools of cobalt. Thus, a crack propagating through the composite will often travel either through tungsten carbide/cobalt interfaces or through tungsten carbide/tungsten carbide interfaces. As a result, cemented tungsten carbide often exhibits gross brittle fracture during more demanding applications, which may lead to catastrophic failure.

Composite materials of the present disclosure may be formed by subjecting ceramic hard particles and a binder to a traditional low pressure sintering process, such as HIP or vacuum sintering, and a high temperature, high pressure sintering process. Current processing of tungsten carbide composites for cutting structures, for example, only provides for a HIP or vacuum sintering process. The addition of a high temperature, high pressure sintering may allow for improvements in the material properties of the resulting product.

In various embodiments, the green bodies may be subjected to a traditional WC or low pressure sintering process, after which a high pressure, high temperature process may be applied. Conversely, the green bodies may first be subjected to a high pressure, high temperature process, after which the traditional WC sintering process may be applied. Additionally, one of ordinary skill in the art would recognize that any combination of traditional sintering processes and high pressure, high temperature processes, as well as multiple cycles of traditional sintering processes and high pressure, high temperature processes may also be used in various other embodiments. Various traditional WC sintering processes, as well as high pressure, high temperature processes, are shown below in Table 1.

TABLE 1

| Technique | Typical Pressure | Typical Temperaure |
|---|---|---|
| | Traditional WC Sintering | |
| Hot Pressing | <14,500 psi | <2200° C. |
| HIP | <43,500 psi | <1600° C. |
| | High Temperature, High Pressure | |
| Rapid Omnidirectional Compaction | <145,000 psi | <1800° C. |
| High Temperature High Pressure (diamond synthesis) | <1,100,000 psi | <1600° C. |

HIP, as known in the art, is described in, for example, U.S. Pat. No. 5,290,507, which is herein incorporated by reference in its entirety. Isostatic pressing generally is used to produce powdered metal parts to near net sizes and shapes of varied complexity. Hot isostatic processing is performed in a gaseous (inert argon or helium) atmosphere contained within a pressure vessel. Typically, the gaseous atmosphere as well as the powder to be pressed are heated by a furnace within the vessel. Common pressure levels for HIP may extend upward to 45,000 psi with temperatures up to 3000° C. For tungsten carbide composites, typical processing conditions include temperatures ranging from 1200-1450° C. and pressures ranging from 800-1,500 psi.

In the hot isostatic process, the powder to be hot compacted is placed in a hermetically sealed container, which deforms plastically at elevated temperatures. Prior to sealing, the container is evacuated, which may include a thermal out-gassing stage to eliminate residual gases in the powder mass that may result in undesirable porosity, high internal stresses, dissolved contaminants and/or oxide formation.

Vacuum sintering, as known in the art, is described in, for example, U.S. Pat. No. 4,407,775, which is herein incorporated by reference in its entirety. The power to be compacted is loaded in an open mold or container for consolidation. The powder is then consolidated by sintering in a vacuum. Suitable pressures for vacuum sintering are about $10^{-3}$ psi or less. Sintering temperatures must remain below the solidus temperature of the powder to avoid melting of the powder. One of ordinary skill in the art would recognize that in addition to these sintering techniques, other low pressure sintering processes, such as inert gas sintering and hot pressing, are within the scope of the present disclosure.

In addition to the traditional WC or low pressure sintering process, the composites of the present disclosure are also subjected to at least one high pressure process, i.e., pressures upwards of 100,000 psi. Examples of high pressure, high temperature (HPHT) process can be found, for example, in U.S. Pat. Nos. 4,694,918; 5,370,195; 4,525,178; 5,676,496 and U.S. Pat. No. 5,598,621.

In a particular embodiment, the composites of the present disclosure are subjected to a process having a pressure ranging from 100,000 psi to 1,500,000 psi and a temperature ranging from 500° C. to 1,600° C. In yet a more particular embodiment, a minimum temperature is about 1200° C. and a minimum pressure is about 500,000 psi. Typical processing may be at a pressure of about 650,000 to 1,000,000 psi and 1300-1450° C. The preferred temperature and pressure in a given embodiment may depend on other parameters such as the presence of a catalytic material, such as cobalt. Generally, a catalyst or binder material is used to promote intercrystalline bonding. Those of ordinary skill will appreciate that a variety of temperatures and pressures may be used, and the scope of the present invention is not limited to specifically referenced temperatures and pressures.

Other high pressure processes may include, for example, rapid omnidirectional compaction (ROC), such as that described in U.S. Pat. No. 6,106,957, which is herein incorporated by reference in its entirety. In the ROC process, a powder metal workpiece preform is disposed in a ceramic shell or envelope, heated to a desired elevated temperature and then placed in a pressure vessel and pressurized to compact the preform. The ceramic shell acts as a liquid die material and, when placed in a suitable pressure vessel and pressurized such as by the use of a hydraulic ram, the ceramic material is rapidly pressurized in a short time interval. The preform is thus rapidly isodynamically pressurized and consolidated.

Hard phase particulate materials that may be used to form the composite materials of the present disclosure may include various materials used to form cermet materials having application in the drill bit and cutting tool industry. In one embodiment, the hard phase materials may include tungsten carbide particles. In other embodiments, the hard phase materials may include metal carbides, borides, silicides, and nitrides. In yet other various embodiments, the hard phase materials may include metal carbides, such as tungsten, titanium, and tantalum carbides, natural diamond, synthetic diamond, cubic boron nitride, and the like.

Carbide particles may be used to form a carbide composite by mixing carbide particles with a metal catalyst. Among the types of tungsten carbide particles that may be used to form sintered bodies of the present disclosure include cast tungsten carbide, macro-crystalline tungsten carbide, carburized tungsten carbide, and cemented tungsten carbide.

As discussed above, one type of tungsten carbide is macrocrystalline carbide. This material is essentially stoichiometric WC in the form of single crystals. Most of the macrocrystalline tungsten carbide is in the form of single crystals, but some bicrystals of WC may form in larger particles. The manufacture of macrocrystalline tungsten carbide is disclosed, for example, in U.S. Pat. Nos. 3,379,503 and 4,834,963, which are herein incorporated by reference.

U.S. Pat. No. 6,287,360, which is assigned to the assignee of the present invention and is herein incorporated by reference, discusses the manufacture of carburized tungsten carbide. Carburized tungsten carbide, as known in the art, is a product of the solid-state diffusion of carbon into tungsten metal at high temperatures in a protective atmosphere. Carburized tungsten carbide grains are typically multi-crystalline, i.e., they are composed of WC agglomerates. Typical carburized tungsten carbide contains a minimum of 99.8% by weight of carbon infiltrated WC, with a total carbon content in the range of about 6.08% to about 6.18% by weight. Tungsten carbide grains designated as WC MAS 2000 and 3000-5000, commercially available from H. C. Stark, are carburized tungsten carbides suitable for use in the formation of the matrix bit body disclosed herein. The MAS 2000 and 3000-5000 carbides have an average size of 20 and 30-50 micrometers, respectively, and are coarse grain conglomerates formed as a result of the extreme high temperatures used during the carburization process.

Another form of tungsten carbide is cemented tungsten carbide (also known as sintered tungsten carbide), which is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide is commercially available in two basic forms: crushed and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making cemented tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may further be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 to about 20 microns are sintered with cobalt to form either spherical or crushed cemented tungsten carbide. In a preferred embodiment, the cemented tungsten carbide is formed from tungsten carbide particles having an average particle size of about 0.8 to about 7 microns. In some embodiments, the amount of cobalt present in the cemented tungsten carbide is such that the cemented carbide is comprised of from about 6 to 16 weight percent cobalt.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide.

Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

The various tungsten carbides disclosed herein may be selected so as to provide a bit that is tailored for a particular drilling application. For example, the type, shape, and/or size of carbide particles used in the formation of a matrix bit body may affect the material properties of the formed bit body, including, for example, fracture toughness, transverse rupture strength, and erosion resistance.

The composite of the present disclosure may also include a binder or catalyst for compaction. Catalyst materials that may be used to form the relative ductile phase of the various composites of the present disclosure may include various group IVa, Va, and VIa ductile metals and metal alloys including, but not limited to Fe, Ni, Co, Cu, Ti, Al, Ta, Mo, Nb, W, V, and alloys thereof, including alloys with materials selected from C, B, Cr, and Mn. In a particular embodiment, the composite may include from about 4 to about 40 weight percent metallic binder.

Following one or more high and low pressure processes, the composite material may be subjected to a typical finishing process, as known in the art, prior to incorporation of the composite piece into the desired application. Composites of this invention can be used in a number of different applications, such as tools for mining and construction applications, where mechanical properties of high fracture toughness, wear resistance, and hardness are highly desired. Composites of this invention can be used to form bit bodies and/or wear and cutting components in such downhole cutting tools as roller cone bits, percussion or hammer bits, and drag bits, and a number of different cutting and machine tools.

Depending on the type of particulate material used to form the composite, the various composites can be used to form a wear surface in such applications in the form of one or more substrate coating layers, or can be used to form the substrate itself, or can be used to form a bit body component.

Figure 3:
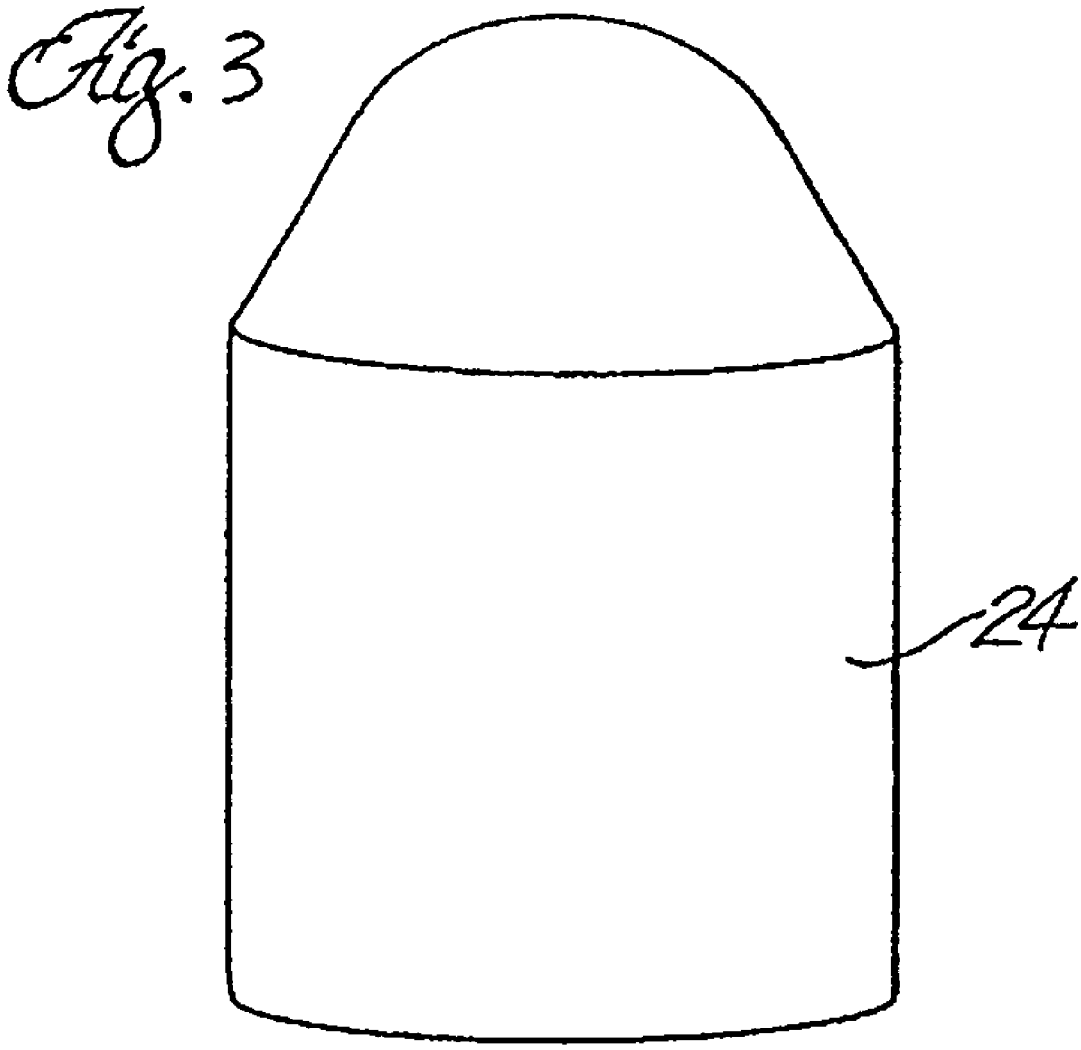
FIG. 3 is a schematic perspective side view of an insert comprising a composite of the present disclosure.
Figure 4:
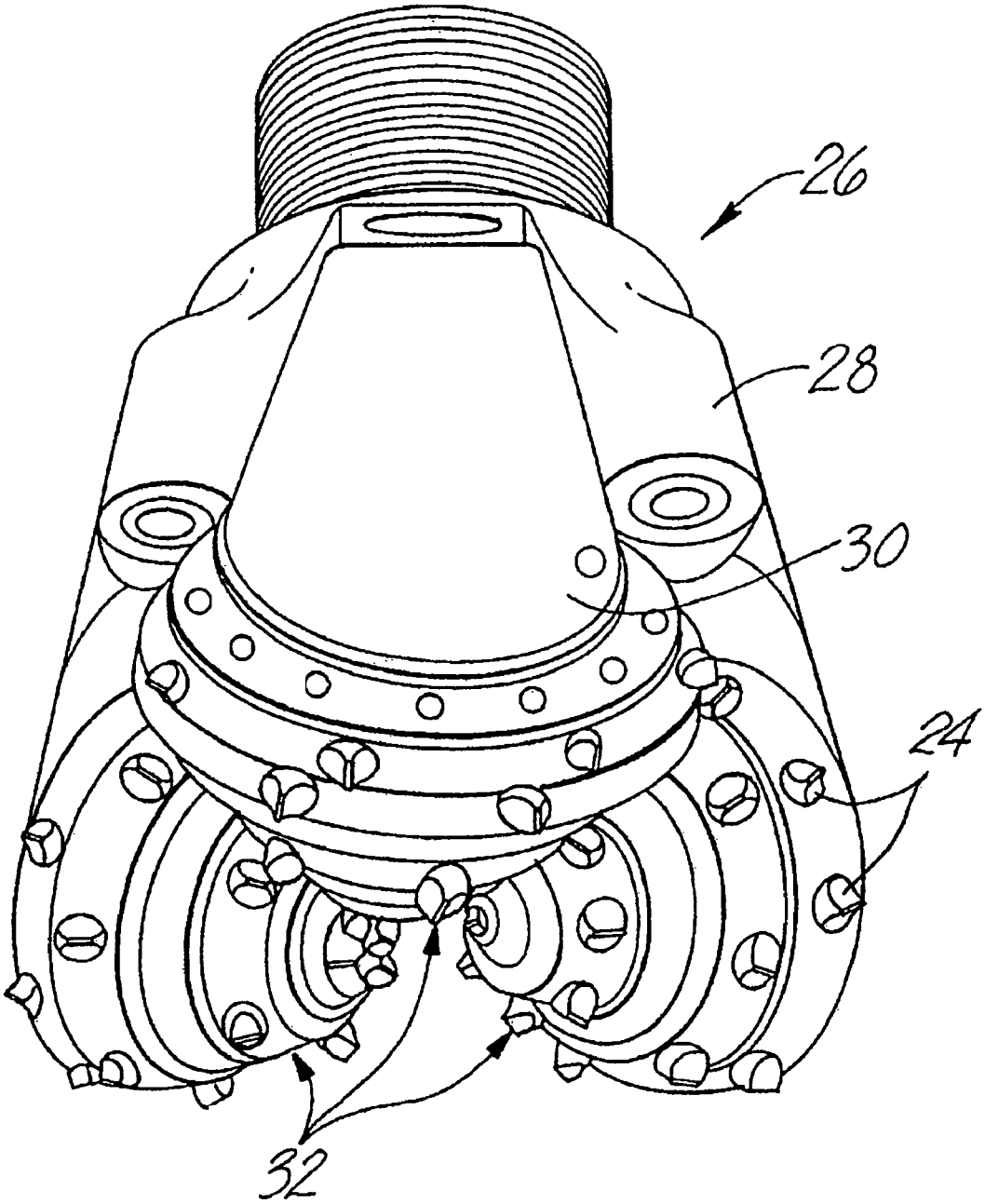
FIG. 4 is a perspective side view of a roller cone drill bit comprising a number of the inserts of FIG. 3.

FIG. 3, for example, illustrates a mining or drill bit insert 24 that is either formed from or is coated a composite material of the present disclosure. Referring to FIG. 4, such an insert 24 can be used with a roller cone drill bit 26 comprising a body 28 having three legs 30, and a cutter cone 32 mounted on a lower end of each leg. Each roller cone bit insert 24 can be fabricated according to one of the methods described above. The inserts 24 are provided in the surfaces of the cutter cone 32 for bearing on a rock formation being drilled.

Figure 5:
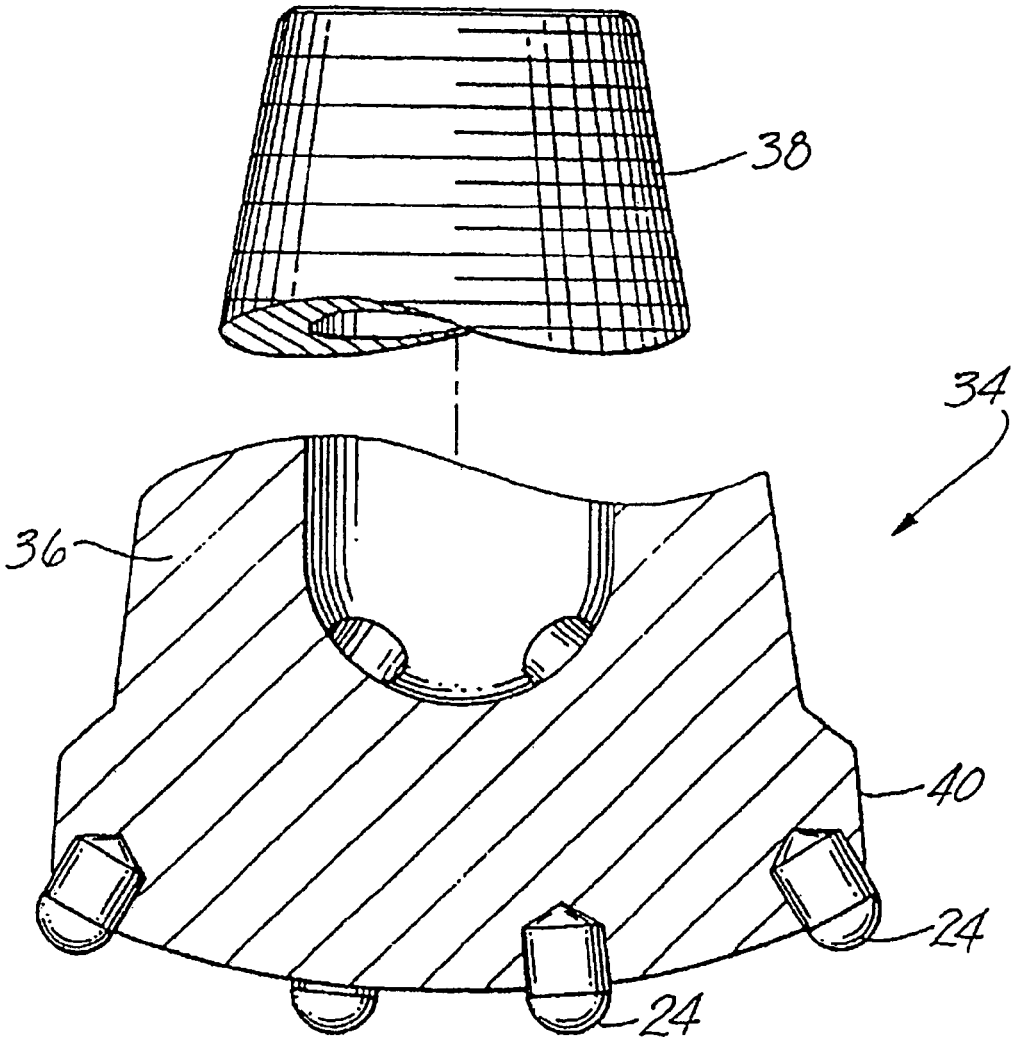
FIG. 5 is a perspective side view of a percussion or hammer bit including a number of inserts comprising a composite of the present disclosure.

Referring to FIG. 5, inserts 24 formed from composites of the present disclosure may also be used with a percussion or hammer bit 34, comprising a hollow steel body 36 having a threaded pin 38 on an end of the body for assembling the bit onto a drill string (not shown) for drilling oil wells and the like. A plurality of the inserts 24 are provided in the surface of a head 40 of the body 36 for bearing on the subterranean formation being drilled.

Figure 6:
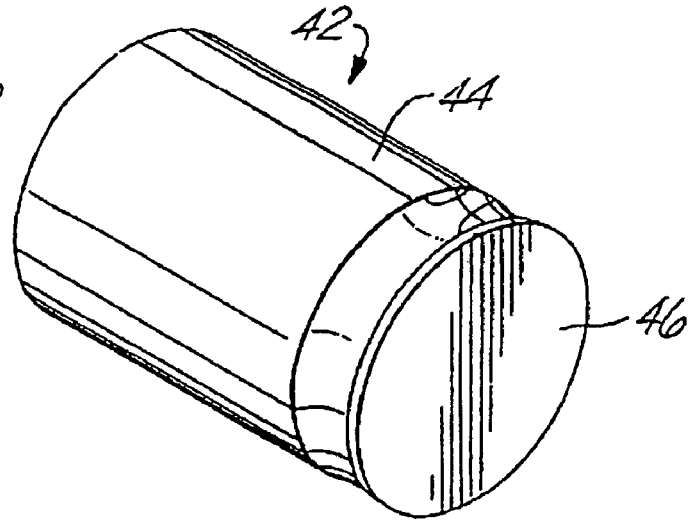
FIG. 6 is a schematic perspective side view of a shear cutter comprising a composite of the present disclosure.
Figure 7:
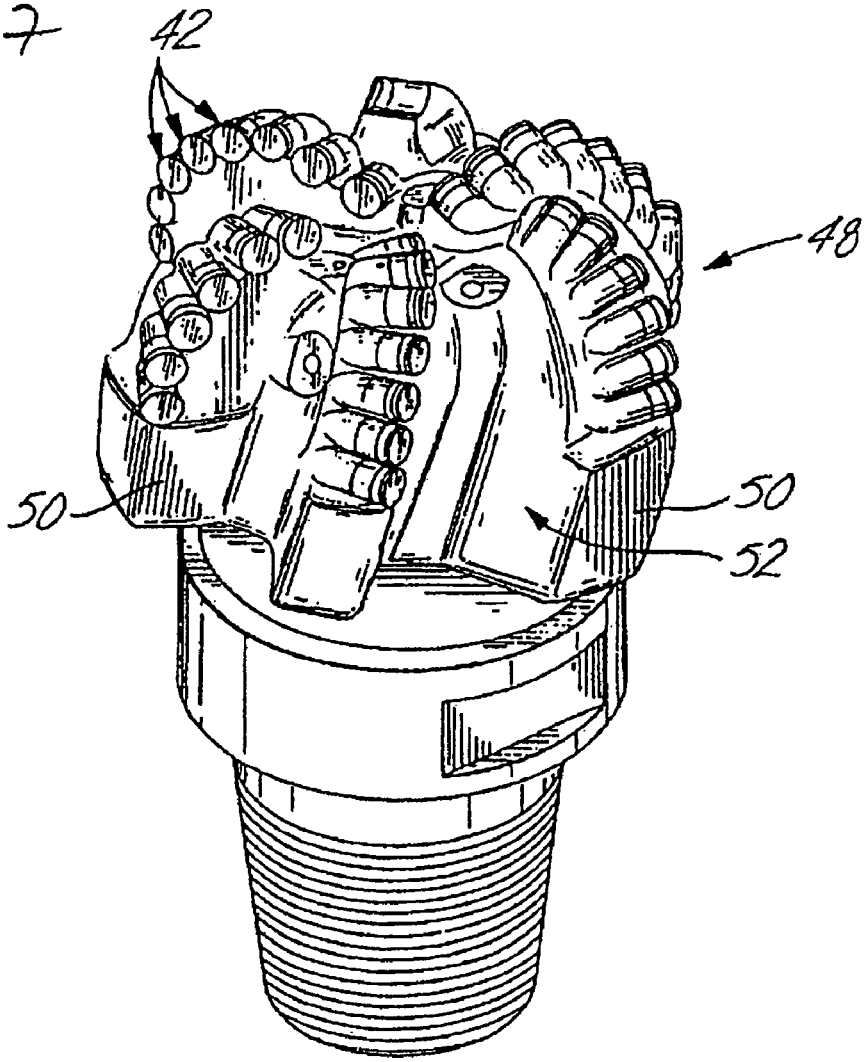
FIG. 7 is a perspective side view of a drag bit comprising a number of the shear cutters of FIG. 6.

Referring to FIG. 6, composites of the present disclosure may also be used to form shear cutters 42 that are used, for example, with a drag bit for drilling subterranean formations. More specifically, composites may be used to form a sintered surface layer on a cutter or substrate 44. Referring to FIG. 7, a drag bit 48 comprises a plurality of such shear cutters 42 that are each attached to blades 50 that extend from a head 52 of the drag bit for cutting against the subterranean formation being drilled. In a particular embodiment, cutters 42 includes a carbide substrate (not shown) formed via a conventional sintering process and HTHP process, as disclosed herein, and a diamond cutting face (not shown) attached thereto following the multiple processes. One of ordinary skill in the art would recognize that in various embodiments other types of cutting elements (such as inserts 24 shown in FIG. 3) formed from composites of the present disclosure may also be used in drag bit 48.

Examples

Composite materials formed in accordance with embodiments of the present disclosure were compared to composites formed by conventional processes, by comparing various properties, including hardness, impact resistance, and fatigue toughness.

Two grades of WC inserts (formed by HIP, 600-2,000 psi, 1200-1400° C.) were obtained from Kennametal, Inc. (Latrobe, Pa.). The first grade contains tungsten carbide particles having an average particle size of about 4 microns and 11 weight percent cobalt ("411"), and the second grade contains WC particles having an average grain size of about 6 microns and 14 weight percent cobalt ("614"). Samples of the 411 and 614 grades were subjected to HTHP processes (600,000-1,000,000 psi, 1200-1400° C.), performed by Sii Megadiamond, Inc. (Provo, Utah), and were compared to comparative samples with no additional HTHP processing.

The samples were subjected to a Vickers microhardness test performed at 72° F. The Vickers microhardness test is an indention method that impresses a diamond pyramid indenter into the sample at load of 500 g. The impression diagonal length (measured microscopically) and test load are used to calculate a hardness value. The results of the Vickers microhardness test, shown in Tables 2a and 2b below, indicate that the inserts formed with the additional high pressure sintering process possess an increased hardness, as compared to traditional inserts.

TABLE 2a

| | Samples - 411 | | | | | Comparative Samples | | |
|---|---|---|---|---|---|---|---|---|
| | 1 | 2 | 3 | 4 | 5 | 1 | 2 | 3 |
| Vickers hardness number | 1154 | 1212 | 1203 | 1212 | 1203 | 1146 | 1146 | 1203 |
| | 1220 | 1178 | 1274 | 1246 | 1203 | 1146 | 1212 | 1220 |
| | 1187 | 1203 | 1264 | 1229 | 1220 | 1139 | 1162 | 1139 |
| | 1255 | 1220 | 1220 | 1246 | 1178 | 1131 | 1146 | 1187 |
| | 1178 | 1203 | 1229 | 1195 | 1238 | 1187 | 1101 | 1146 |
| Average | 1199 | 1203 | 1238 | 1226 | 1209 | 1150 | 1154 | 1179 |
| Difference in microhardness | | | | | | | | |
| 5% | | | | | | | | |

TABLE 2b

| | Sample | | | | | | | |
|---|---|---|---|---|---|---|---|---|
| | Samples - 614 | | | | | Comparative Samples | | |
| | 6 | 7 | 8 | 9 | 10 | 4 | 5 | 6 |
| Vickers | 1079 | 1065 | 1079 | 1058 | 1055 | 962 | 1016 | 935 |
| hardness | 1051 | 1070 | 1056 | 992 | 1051 | 968 | 985 | 989 |
| number | 1021 | 11075 | 1002 | 1072 | 1099 | 1042 | 986 | 859 |
| | 1076 | 1009 | 1123 | 1024 | 1050 | 1007 | 997 | 949 |
| | 1036 | 1063 | 1100 | 1123 | 1057 | 1010 | 1002 | 990 |
| Average | 1053 | 1056 | 1073 | 1054 | 1062 | 998 | 997 | 945 |
| | Difference in microhardness 8% | | | | | | | |

Samples 11-18 and Comparative Samples 7-13 of 411 inserts, formed as described above, were subjected to an impact test. The inserts are placed in a rigid fixture, and a weight of 16.5 kg is dropped from a predetermined height to have a set energy ranging from 6-8 Joules. The surface of the insert is then observed for chipping or other signs of impact damage. The impact resistance of an insert is a measure of the toughness of the insert. The results of the impact test, shown below in Table 3, indicate that the inserts formed with the additional high pressure sintering process can withstand impact that traditional inserts cannot withstand, and thus have a greater impact resistance.

TABLE 3

| Sample | Set Energy (J) | Hitting times | Observation | Classification |
|---|---|---|---|---|
| Sample 11 | 8 | 3 | Spalling | Fail |
| Sample 12 | 8 | 1 | Spalling | Fail |
| Sample 13 | 8 | 2 | Spalling | Fail |
| Sample 14 | 7 | 5 | No visual damage | Pass |
| Sample 15 | 7 | 1 | Spalling | Fail |
| Sample 16 | 7 | 5 | No visual damage | Pass |
| Sample 17 | 7 | 5 | No visual damage | Pass |
| Sample 18 | 7 | 4 | Small chipping | Fail |
| Comparative Sample 7 | 7 | 1 | Spalling | Fail |
| Comparative Sample 8 | 7 | 1 | Spalling | Fail |
| Comparative Sample 9 | 7 | 1 | Spalling | Fail |
| Comparative Sample 10 | 7 | 1 | Spalling | Fail |
| Comparative Sample 11 | 7 | 1 | Spalling | Fail |
| Comparative Sample 12 | 6 | 1 | Spalling | Fail |
| Comparative Sample 13 | 6 | 1 | Spalling | Fail |

Samples 19-26 and Comparative Samples 14-21 of 614 inserts were subjected to the impact test, with set energies ranging from 2-3 Joules, the results of which are shown in Table 4 below. Compared to the 411 inserts, the 614 inserts have a sharp edge. Similarly, the impact test for the 614 inserts indicate that the inserts formed with the additional high pressure sintering process can withstand impact that traditional inserts cannot withstand, and thus have a greater impact resistance

TABLE 4

| Sample | Set Energy (J) | Hitting times | Observation | Classification |
|---|---|---|---|---|
| Sample 19 | 3 | 5 | Flattening | Pass |
| Sample 20 | 3 | 5 | Flattening | Pass |
| Sample 21 | 3 | 1 | Small chipping | Fail |
| Sample 22 | 2 | 1 | Spalling | Fail |
| Sample 23 | 2 | 5 | Flattening | Pass |
| Sample 24 | 2 | 5 | Flattening | Pass |
| Sample 25 | 2 | 5 | Flattening | Pass |
| Sample 26 | 2 | 5 | Flattening | Pass |
| Comparative Sample 14 | 3 | 1 | Spalling | Fail |
| Comparative Sample 15 | 3 | 1 | Spalling | Fail |
| Comparative Sample 16 | 3 | 1 | Spalling | Fail |
| Comparative Sample 17 | 2 | 3 | Spalling | Fail |
| Comparative Sample 18 | 2 | 1 | Spalling | Fail |
| Comparative Sample 19 | 2 | 1 | Spalling | Fail |
| Comparative Sample 20 | 2 | 1 | Spalling | Fail |
| Comparative Sample 21 | 2 | 1 | Spalling | Fail |

Samples 27-28 and Comparative Samples 22-24 of 614 inserts, formed as described above, were subjected to a fatigue test. The inserts were subjected to fatigue contact testing using a compression-compression cyclic loading on a servo-hydraulic load frame under sinusoidal loading conditions between 800 and 8,000 pounds or 900 and 9,000 pounds. The results of the fatigue test, shown in Table 5 below, show that the inserts formed with the additional high pressure sintering process can withstand cyclical, compressive loads that a traditional insert cannot withstand, and thus have greater fatigue resistance.

TABLE 5

| Sample | Hz. | Load (lbs) | Cycles | Comments |
|---|---|---|---|---|
| Sample 27 | 20 | 900-9,000 | 500,000 | No chipping (Passed) |
| Sample 28 | 20 | 900-9,000 | 1,000,000 | No chipping (Passed) |
| Comparative Sample 22 | 20 | 800-8,000 | 100,000 | Chipping (Failed) |
| Comparative Sample 23 | 20 | 900-9,000 | 100,000 | Chipping (Failed) |
| Comparative Sample 24 | 20 | 900-9,000 | 500,000 | Chipping (Failed) |

Figure 8:
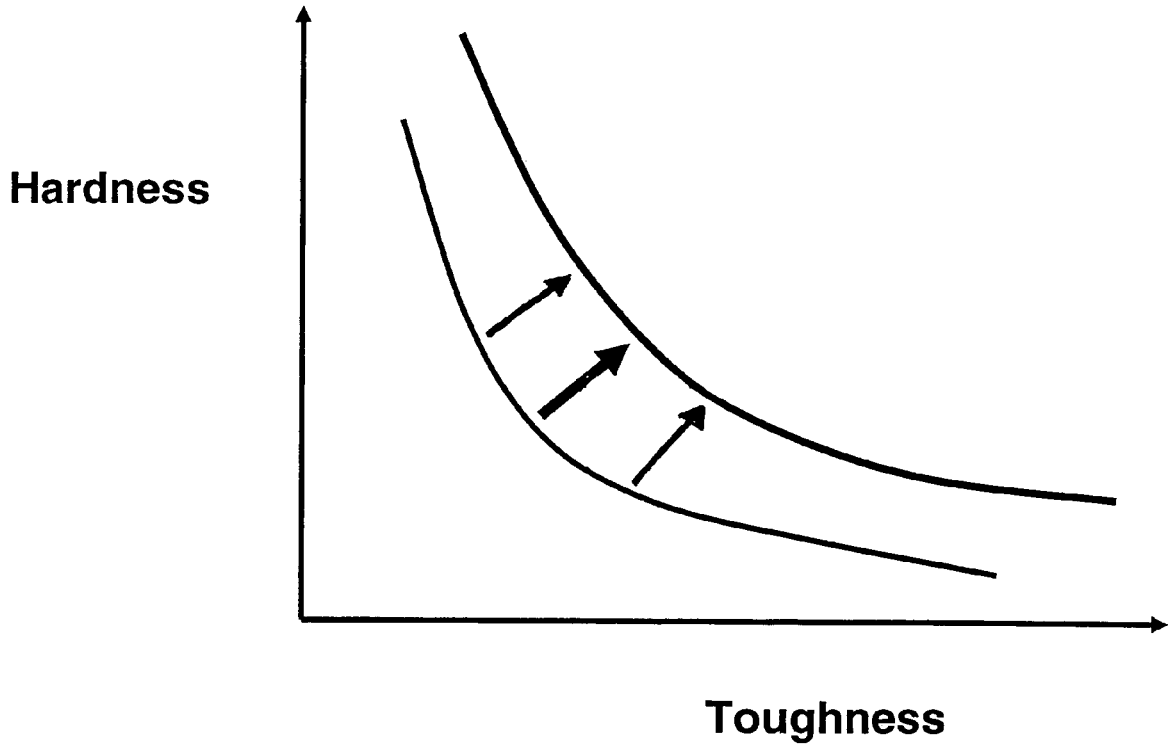
FIG. 8 shows a graphical comparison of fracture toughness vs. wear number for conventional carbides and carbides in accordance with embodiments of the present disclosure.

From these tests, it can be predicted that composites formed in accordance with the present disclosure may have increases in hardness and toughness. Thus, as shown in FIG. 8, a shift in the hardness/toughness curve for composites of the present disclosure may be obtained.

Advantageously, embodiments of the present disclosure may include one or more of the following. The addition of a high pressure, high temperature process to the traditional sintering process may provide for composites having higher hardness and toughness, as compared to composites formed using traditional means. Thus, while hardness and toughness are inversely related such that increases in hardness typically result in decreased toughness, and vice versa, embodiments of the present disclosure may advantageously allow for improvements in both properties, and thus a shift in the hardness/toughness curve.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method for forming a carbide composite, comprising:

providing a mixture consisting of metal carbide particles and a metallic binder in a container;

sintering the container contents at a first processing condition having a pressure of less than about 45,000 psi to form a cermet of the metal carbide particles surrounded by the metallic binder;

and sintering the container contents consisting of the cermet at a second processing condition having a pressure of greater than about 500,000 psi.

2. The method of claim 1, wherein the metallic binder comprises at least one of cobalt, iron, nickel, and alloys thereof.

3. The method of claim 1, wherein the first sintering process comprises at least one of hot isostatic pressing and vacuum sintering.

4. The method of claim 1, wherein the second sintering process comprises at least one of high pressure, high temperature sintering and rapid omnidirectional compaction.

5. The method of claim 1, wherein the first processing condition has a pressure less than about 6,000 psi.

6. The method of claim 1, wherein the second processing condition has a pressure ranging from 500,000 to 1,500,000 psi.

7. The method of claim 1, further comprising:

sintering the cermet at a third processing condition having a pressure of less than about 45,000 psi; and sintering the cermet at a fourth processing condition having a pressure of greater than about 500,000 psi.

8. The method of claim 7, wherein the first and third processing conditions are substantially the same.

9. The method of claim 7, wherein the second and fourth processing conditions are substantially the same.

10. The method of claim 1, wherein the second processing condition has a pressure of at least about 650,000 psi.

11. A method for forming a sintered body, comprising:

providing a mixture consisting of hard particles and a metallic binder in a container;

sintering the container contents at a first processing condition having a pressure of less than about 45,000 psi to form a cermet of the hard particles surrounded by the metallic binder;

and sintering the container contents consisting of the cermet at a second processing condition having a pressure of greater than about 500,000 psi.

12. The method of claim 11, wherein the hard particles comprise at least one of a metal carbide, borides, silicide, and nitride.

13. The method of claim 11, wherein the metallic binder comprises at least one of cobalt, iron, nickel, and alloys thereof.

14. The method of claim 11, wherein the first sintering process comprises at least one of hot isostatic pressing and vacuum sintering.

15. The method of claim 11, wherein the second sintering process comprises at least one of high pressure, high temperature sintering and rapid omnidirectional compaction.

16. The method of claim 11, further comprising:

sintering the cermet at a third processing condition having a pressure of less than about 45,000 psi; and sintering the cermet at a fourth processing condition having a pressure of greater than about 500,000 psi.

17. The method of claim 16, wherein the first and third processing conditions are substantially the same.

18. The method of claim 16, wherein the second and fourth processing conditions are substantially the same.

19. The method of claim 11, wherein the first processing condition has a pressure less than about 6,000 psi.

20. The method of claim 11, wherein the second processing condition has a pressure ranging from 500,000 to 1,500,000 psi.

21. The method of claim 11, wherein the second processing condition has a pressure of at least about 650,000 psi.

* * * * *